United States Patent [19]

Prochazka et al.

[11] 4,227,441

[45] Oct. 14, 1980

[54] HYDRAULIC SERVO-MOTOR FOR A REGULATING VALVE HAVING A HYDRAULIC CLOSING MECHANISM

[75] Inventors: Kamil Prochazka, Windisch; Franz Suter, Gebenstorf, both of Switzerland

[73] Assignee: BBC Brown Boveri & Company Limited, Baden, Switzerland

[21] Appl. No.: 946,738

[22] Filed: Sep. 29, 1978

[30] Foreign Application Priority Data

Sep. 29, 1977 [CH] Switzerland ..... 11899/77

[51] Int. Cl.[3] ..... F15B 9/10; F15B 13/16

[52] U.S. Cl. ..... 91/374; 91/382; 91/388; 91/461

[58] Field of Search ..... 91/388, 382, 374

[56] References Cited

U.S. PATENT DOCUMENTS

| | | | |
|---|---|---|---|
| 2,141,260 | 12/1938 | Caughey | 91/382 |
| 2,974,639 | 3/1961 | O'Connor et al. | 91/388 |
| 3,222,996 | 12/1965 | Thieme et al. | 91/382 |
| 3,386,343 | 6/1968 | Gray | 91/388 |

FOREIGN PATENT DOCUMENTS

| | | | |
|---|---|---|---|
| 1142014 | 2/1969 | United Kingdom | 91/388 |

*Primary Examiner*—Paul E. Maslousky

*Attorney, Agent, or Firm*—Burns, Doane, Swecker & Mathis

[57] ABSTRACT

A valve actuator is disclosed having a servo-motor which regulates the position of a main valve that controls steam supply to a turbine. A hydraulic input signal acts on a pilot valve within the valve actuator body to move a valve spool in response to the input signal. Movement of the valve spool permits oil to flow into a cylinder in which the servo-motor is located. The flow of oil into the cylinder causes a piston which is a part of the servo-motor to move upwardly. Movement of the servo-motor is regulated by a cam and follower arrangement which transfers the motion of the servo-motor to a valve sleeve. The valve sleeve, which has a differential piston area, shuts-off the supply of oil to the servo-motor. The cam and follower arrangement provides for a linear correlation between the hydraulic input signal and the operation of the servo-motor. Increased closing forces provided by the differential piston reduce vibration of the valve sleeve and the servo-motor.

14 Claims, 1 Drawing Figure

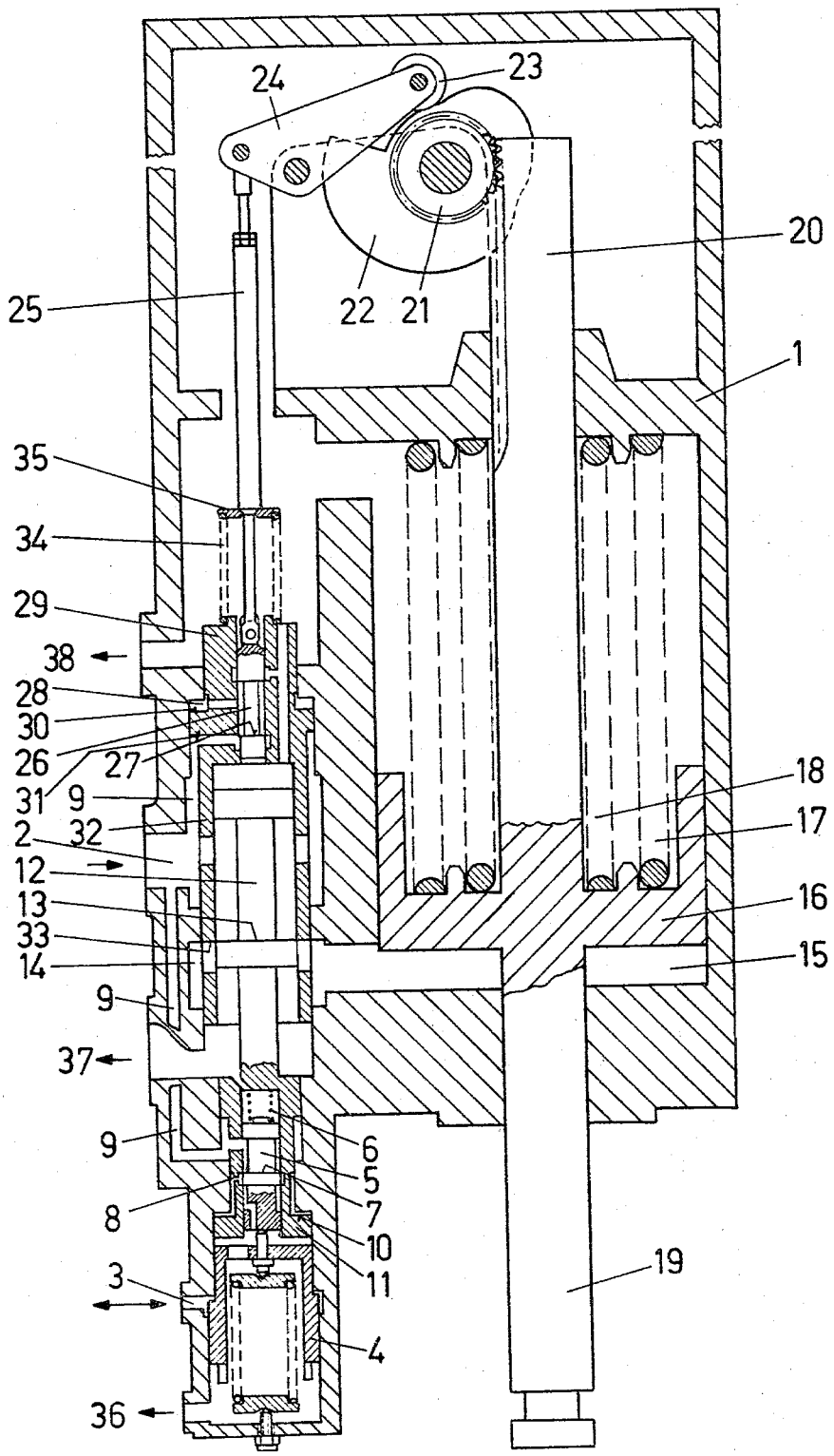
24
23
20
25
22
21
1
35
34
29
38
28
30
26
27
31
9
32
2
12
13
33
14
9
37
9
6
5
8
7
10
11
3
4
36
18
17
16
15
19

HYDRAULIC SERVO-MOTOR FOR A REGULATING VALVE HAVING A HYDRAULIC CLOSING MECHANISM

The present invention relates to a hydraulic valve actuator for regulating valves.

Regulating valves, as presently used in large power plant turbines, are subjected to high tensile stresses that are caused by vibrations when loading and unloading follow each other in rapid succession. The stresses and vibrations impair the operation of the valve, with the result that the regulating process cannot be accomplished at desired optimum efficiency. It is possible to suppress these vibrations, for example, by the use of stabilizers within the valve. Such stabilizers, however, in the case of rapid stroke variations in the closing direction still cause the above-mentioned impairment of the regulating process, due to the large inertia forces of the regulating mechanism. The components in the regulation valve requires a relatively large acceleration to overcome the effect of the regulating piston, because the mating joint between the interacting regulating components cannot be maintained under these extreme vibration conditions.

It is the aim of the present invention to eliminate these deficiencies and to make it possible to produce the desired precise correlation between a hydraulic input signal and the regulating valve stroke throughout the entire range of actuator operation.

The servo-motor for controlling the regulating valve of the present invention operates in response to a hydraulic input signal. A pilot valve, having a spring-loaded control piston, controls an auxiliary servo-valve which operates together with an amplifier piston surface carried on a valve spool. The valve spool forms a rigid unit with the amplifier piston and has a valve surface which controls the flow of oil from an inlet to a servo-motor in which a piston operates to control the regulating valve. A closing mechanism which transmits the motion of the piston to a valve sleeve, operates together with the valve spool in order to set the position of the piston in accordance with the regulating signal pressure. A gear system, typically a cam and follower arrangement, produces a linear interconnection between the regulating signal pressure and the amount of steam. The closing mechanism includes a regulating valve connected to the gear system, and a valve sleeve controlled by the regulating valve. The valve sleeve is typically a differential piston and operates together with the regulating valve to shut-off oil flow to the servo-motor. cl BRIEF DESCRIPTION OF THE DRAWING A preferred embodiment of the present invention is described with reference to the single accompanying drawing wherein like members bear like reference numerals. The single drawing is a cross-sectional view of a regulating valve according to the present invention.

With reference to the single accompanying drawing, a housing 1 contains the control valve components within its left portion and the servo-motor components within its right portion. In the following description of the layout and the operation of the servo-motor only the essential components are being mentioned and denoted by reference numerals.

The control valve components, the servo-motor components and a closing mechanism are actuated by hydraulic fluid. This fluid is kept at a uniform pressure during operation and is pumped into the system through a port 2. Oil which is impressed with a pressure signal by a pressure device (not illustrated) is supplied by a conventional regulating circuit and enters through a port 3. The oil is supplied through the port 3 to a pilot valve having a spring-loaded control piston 4. The oil loads the control piston 4 and an auxiliary servo-valve 5 which is biased downwardly by a coil spring 6. An upper valve surface 7 on the auxiliary servo-valve 5 controls access to an annular chamber 8 which is supplied with oil from chamber 9. The oil, which is under constant pressure, loads a piston area 10 of an amplifier piston 11 which moves downwardly in response to the oil pressure. The amplifier piston 11 forms the lower portion of a valve spool 12 and forms a cylinder in which the above-mentioned auxiliary servo-valve 5 and the coil spring 6 are disposed.

The valve spool 12 which moves downwardly with the amplifier piston 11, carries a valve surface 13 which regulates access to an annular chamber 14 in communication with a cylinder interior 15. Oil flows into this annular chamber and the cylinder interior 15, in which the servo-motor is disposed to load a piston 16, pushing it upwardly against the force of coil springs 17 and 18. Movement of the piston 16 is transferred by a piston rod 19 to a valve (not illustrated) controlling the steam supplied to the turbine.

A closing mechanism is actuated by a piston rod 20 which is connected to piston 16 to maintain a new equilibrium position. The upper end of the rod 20 carries a gear rack which engages a pinion 21 A cam 22, rigidly mounted with the pinion to prevent torsion, rotates with the pinion. The contour of the cam establishes a desired linear interconnection between the magnitude of the input signal and the stroke of the piston 16 to regulate the amount of steam supplied to the turbine. The lifting motion of the cam is transmitted by a follower 23, preferably a roller to a two-arm lever 24 which is attached to a return rod 25. The lower end of the return rod is hinged to a regulating valve 26, a part of the closing mechanism, and is slidable within a bore in a valve sleeve 29, 32. A valve surface 27 carried on the regulating valve 26 regulates access to a duct connecting the oil chamber 2, 9 with an oil chamber 28. The chamber 28 is positioned above the upper portion of a piston surface 30, 31 on the valve sleeve 29, 32 which is in the form of a differential piston. Since the upper piston surface 30 is larger than the lower piston surface 31, the sleeve moves downwardly under the influence of oil flowing through chamber 28.

The valve sleeve 29, 32 which is part of the closing mechanism, operates in conjunction with the valve spool 12 to regulate the flow of oil from the oil chamber 2, 9 into the annular chamber 14, and thus into the cylinder interior 15 underneath the piston 16. The valve sleeve 29, 32 is thus moved downwardly when piston surface 30, 31 is loaded. A valve surface 33 on the valve sleeve 29, 32 will now close off the annular chamber 14, which had been opened at the beginning of the regulating operation by the upper valve surface 13 of the spool 12. The closing of 14 cuts off any further oil flow into the cylinder interior 15 thereby completing the regulating operation. A coiled compression spring 34 and a spring collar 35 disposed about the return rod prevent the follower 23 from lifting off the cam 22.

The arrows 36 and 38 represent overflow oil lines and arrow 37 a return line in to the power oil chamber.

During operation, the steam supplied to the turbine is increased by providing an input signal 3 to the pilot valve which loads the shoulder of the control piston 4 and urges the piston downwardly. The movement of the control piston 4 permits the auxiliary servo-valve 5 to slide downwardly under the influence of a spring 6, opening a passage 8 through which fluid flows from the oil supply 2 to the amplifier piston 11 on the valve spool 12. Loading of the amplifier piston surface 10 urges the valve spool 12 downwardly and opens communication between the oil supply 2 and the cylinder interior 15 in which the piston 16 operates. The piston 16 controls the position of a valve attached to a piston rod 19 carried by the piston.

Once the valve is positioned, the closing mechanism is actuated by the piston rod 20 attached to the piston 16 to maintain the valve in a new equilibrium position. The cam 22 and follower 23 transmits the movement of the piston 16 to the regulating valve 26 through a linking rod 25. Oil is supplied to the piston areas of the differential piston 30, 31 carried by the valve sleeve 29, 32 through a passage 28 opened by movement of the regulating valve 26. The force exerted on the differential piston 30, 31 moves the attached valve sleeve 29, 32 to a closed position, interrupting the flow of oil into the cylinder interior 15. Oil within the housing reterns to the supply through passages in the valve sleeve and the oil return line 37.

The closing mechanism maintains the valve in an equilibrium position in response to the regulating signal. The coil springs 17, 18 within the piston cylinder 15 exert a closing force on the piston which acts against an opening force supplied by the oil flow regulated by the control valve. A constant variation of the opening force is supplied by fluctuations in the input signal 3 due to the operation of the turbine.

In order to reduce the amount of steam supplied to the turbine, the input signal pressure 3 acting on the pilot valve is reduced. The auxiliary servo-valve 5 is urged upwardly by the control piston 4 to stop oil flow to the amplifier piston 11. This interruption of the oil flow permits the valve spool 12 to move upwardly so that the annular valve 13 carried on the valve spool 12 prevents oil from flowing into the cylinder interior 15. Oil trapped in the cylinder drains through passages in the valve sleeve 29, 32 and the actuator housing.

If the valve sleeve 29, 32 of the closing mechanism includes a differential piston a hydraulically reinforced closing moment acts on the valve sleeve 29, 32 during the closing operation. This increased moment will relieve a portion of the load on the components of the mechanical closing system. It is therefore possible to press the follower 23 against the cam 22 under a relatively low spring force while still ensuring a continuous mating between the cam and follower. Due to the increased closing forces, the maximum closing speed of the heavy control elements will correspondingly be much greater. Damping of the valve sleeve 29, 32 will thus become unnecessary, thereby improving the accuracy in the positioning of the piston 16. Thus, improved regulation of the valve controlling the steam supplied to the turbine will be provided during rapid changes in the priming signal pressure.

Additionally, the use of a cam 22 and follower 23 in transmitting the motion of the piston rod 20 to be regulating valve 26 provides greater accuracy in controlling the position of the valve. A relatively small change in the position of the valve is amplified by the cam 22, which allows the regulating valve 26 to be controlled to a finer tolerance.

The principles, preferred embodiments and modes of operation of the present invention have been described in the foregoing specification. The invention which is intended to be protected is not limited to the particular forms disclosed, as these are merely illustrative and not restrictive examples. Variations and changes may be made by those skilled in the art without departing from the scope and spirit of the present invention.

We claim:

1. A valve actuator comprising:

servo-motor means a housing;

control valve means, contained within said housing, for selectively placing said servo-motor means in fluid communication with a source of fluid under pressure and with a drain;

cam means responsive to movement of said servo-motor means for closing said control valve means;

said control valve means including a valve sleeve, which valve sleeve is movable with respect to said housing; and said control valve means further including a regulating valve slideably arranged within said valve sleeve and movable with respect to said housing, movement of said regulating valve being responsive to movement of said cam means and movement of said valve sleeve being responsive to movement of said regulating valve, said valve sleeve being movable to close said control valve means.

2. The valve actuator according to claim 1 wherein said control valve means includes pilot valve means for operating said control valve means, which pilot valve means is responsive to a fluid pressure signal.

3. The valve actuator according to claim 1 wherein said servo-motor means includes:

a piston mounted for reciprocating movement in a cylinder; and fluid conduit means for providing fluid communication between said control valve means and a portion of said cylinder faced by one side of said piston.

4. The valve actuator according to claim 2 wherein said servo-motor means includes a rod movable with opening and closing movement of said main valve.

5. The valve actuator according to claim 4 wherein said cam means includes:

a rotatable cam adjacent said rod;

gear means for rotating said cam in response to a movement of said rod;

a follower in contact with said cam; and lever means connecting said follower with said control valve means for closing said control valve means upon a predetermined opening movement of said rod.

6. The valve actuator according to claim 5 wherein said control valve means further includes:

a valve spool;

said valve sleeve having supply ports and drain ports spaced apart longitudinally, said pilot valve means being arranged to displace said spool in a first direction relative to said sleeve to open said supply ports and thereby supply pressure fluid to said servo-motor means, said regulating valve being operatively connected to said follower and arranged to direct pressure fluid to displace said valve sleeve in said first direction relative to said spool to close said supply ports upon an opening movement of said rod, and said regulating valve being arranged to displace said valve sleeve relative to said spool in a second direction, opposed to said first direction, upon a closing movement of said rod.

7. A valve actuator comprising:

a piston mounted in a cylinder for reciprocating movement;

supply conduit means for supplying pressure fluid to one side of said piston to urge said piston in a first direction;

spring means for urging said piston in a second direction opposed to said first direction;

said piston including a piston rod movable with said piston;

said supply conduit means including a housing;

said supply conduit means also including control valve means for selectively supplying pressure fluid to said one side of said piston;

cam means for transmitting a motion of said piston rod to said control valve means;

said control valve means including a valve sleeve, which valve sleeve is movable with respect to said housing; and said control valve means further including a regulating valve slidably arranged within said valve sleeve and movable with respect to said housing, movement of said regulating valve being responsive to movement of said cam means and movement of said valve sleeve being responsive to movement of said regulating valve, said valve sleeve being movable to close said control valve means.

8. The valve actuator according to claim 7 wherein said cam means includes:

a rotatable cam;

follower means for transmitting a motion of said cam to said control valve means; and biasing means for maintaining said follower means in continuous contact with said cam, said cam means providing a linear connection between said piston rod and said control valve means.

9. The valve actuator according to claim 8 wherein said cam means further includes linking means connecting said follower means with said control valve means for closing said control valve means upon a predetermined opening movement of said piston rod.

10. The valve actuator according to claim 7 wherein said control valve means includes pilot valve means for operating said control valve means in response to an opening signal.

11. The valve actuator according to claim 10 wherein said control valve means includes:

a valve spool;

said valve sleeve having supply and drain ports spaced apart longitudinally, and said pilot valve means being arranged to displace said valve spool relative to said valve sleeve to open said supply ports, thereby initiating communication between said supply conduit means and said piston.

12. The valve actuator according to claim 11 wherein said regulating valve is operatively connected to said cam means, said regulating valve being slidable within said valve sleeve to direct pressure fluid to displace said valve sleeve relative to said spool in said second direction upon movement of said piston in said first direction, thereby stopping the supply of pressure fluid to said one side of said piston, and said regulating valve being arranged to displace said valve sleeve relative to said spool in said first direction upon movement of said piston in said second direction.

13. The valve actuator according to claim 12 wherein said regulating valve directs pressure fluid to a differential piston surface carried on said valve sleeve.

14. The valve actuator according to claims 1 or 7 wherein said valve sleeve includes a differential piston surface, said regulating valve being arranged to direct pressure fluid to said differential piston surface.

* * * * *